United States Patent [19]

Yoshida

[11] Patent Number: 4,986,204

[45] Date of Patent: Jan. 22, 1991

[54] OSCILLATIONLESS SEMISUBMERGED HIGH-SPEED VESSEL

[76] Inventor: Toshio Yoshida, 2-23, Rikyumae-Machi 1-Chome, Suma-Ku, Kobe-Shi, Hyogo-Ken, Japan

[21] Appl. No.: 424,368

[22] Filed: Oct. 19, 1989

[30] Foreign Application Priority Data

Oct. 20, 1988 [JP] Japan ..... 63-262730
Aug. 23, 1989 [JP] Japan ..... 1-214874

[51] Int. Cl.[5] ..... B63B 1/12

[52] U.S. Cl. ..... 114/61; 114/121; 114/126

[58] Field of Search ..... 114/61, 121, 125, 56, 114/57, 123, 162, 126

[56] References Cited

U.S. PATENT DOCUMENTS 4,702,189 10/1987 Schlichthorst ..... 114/61
4,708,077 11/1987 Balquet et al. ..... 114/61
4,763,596 8/1988 Yoshida ..... 114/61

FOREIGN PATENT DOCUMENTS 110697 8/1980 Japan ..... 114/61
43080 4/1981 Japan ..... 114/61
50292 3/1987 Japan ..... 114/61

*Primary Examiner*—Sherman Basinger
*Assistant Examiner*—Stephen P. Avila
*Attorney, Agent, or Firm*—Wenderoth, Lind & Ponack

[57] ABSTRACT

An oscillationless semisubmerged high-speed vessel comprises at least one lower hull submerged below the water surface in the cruising state of the vessel, an upper hull above the water surface and struts connecting the lower hull and an upper hull. The lower hull possesses horizontal fins controlling longitudinal and transverse oscillations of the vessel, steering devices, water ballast tanks for adjusting water line of the vessel and propelling means. The struts are so designed that the water plane area is small so as to minimize the oscillation force, i.e. the vessel does not have a self-stabilizing ability both longitudinally and transversely with only reverse buoyancy kept by the struts when the vessel heels. The struts are constructed to have a sufficient strength for connection of the lower hull and an upper hill. The bulged structures are constructed to contain the propelling means. The struts and the bulged structures are disposed in a midship part of the lower hull to minimize longitudinal oscillations of the vessel due to the wave heaving forces which are vertical components of wave exciting forces generated at both fore and aft parts of the vessel. Steering devices are disposed at a fore part of the lower hull to prevent the vessel from transverse oscillations at an initial stage of healing. Therefore the vessel of this invention can eliminate the oscillations longitudinally and transversely. Thus the vessel of this invention can be an oscillationless high speed vessel which navigates for a long time without causing large accelerative oscillations due to waves on the sea surface.

6 Claims, 9 Drawing Sheets

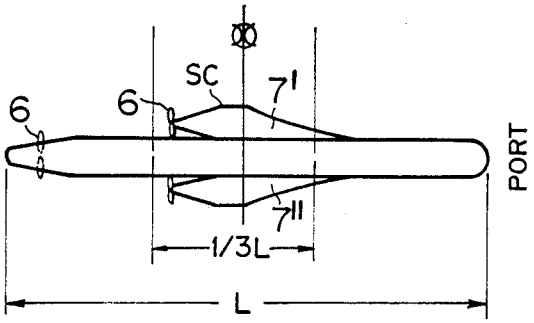
FIG. 11
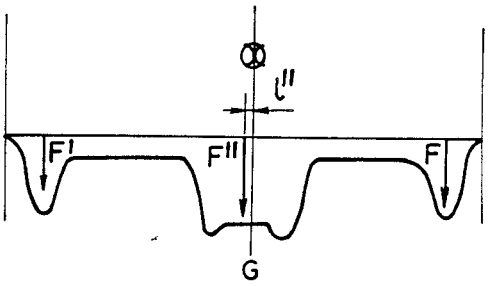
FIG. 12
FIG. 13-1
FIG. 13-2
FIG. 13-3
FIG. 13-4
FIG. 13-5
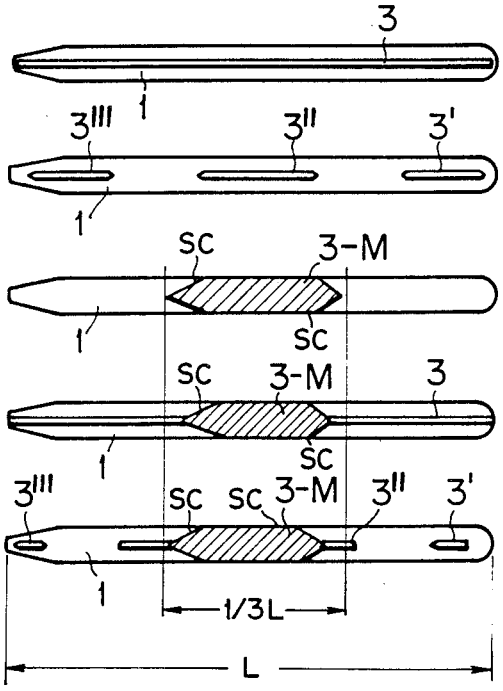

OSCILLATIONLESS SEMISUBMERGED HIGH-SPEED VESSEL

BACKGROUND OF THE INVENTION

This invention relates to semisubmerged high-speed vessels, and more particularly to vessel hull structures and hull equipment designed to make the vessel oscillationless. The vessel is an oscillationless vessel of the type in which a mono-lower hull or twin-lower hulls under water and an upper hull above water are connected by way of struts.

It is a universal requirement of transportation media to carry objects faster, cheaper and in greater quantities. In the marine transportation business, the fulfilment of these requirements has been an ever continuing goal from ancient times. The same goal has been sought also in the shipbuilding industry. In particular, to increase the speeds of vessels is the biggest requirement of naval architectural technology. Recent remarkable progress in aeronautical engineering makes the requirement of vessel speed urgent.

High speeds of a vessel such as 30 Knots to 40 Knots have already been realized by warships. However, it has not yet been achieved by merchant vessels in navigating for a long time across the ocean.

Vessels are subjected to large oscillations due to waves during navigation in oceans. When the oscillation generates an acceleration of more than ($\frac{1}{2}$)G, the human body cannot endure this motion for a long time, and further, the hull, machinery and equipment are also likely to be damaged.

The duration of high speed navigation of warships is limited. Therefore, the oscillation problem of a warship has been solved by using hull, machinery and equipment which can endure the problem during this limited time and also by training the crews.

For a merchant vessel, however, whose business is to transport, the problem cannot be solved in the same way as that for warships. A vessel which can carry objects for a long time at high speed without oscillation in waves is desired. As a method to control oscillation in the conventional displacement mono-hull vessel, the use of bilge keels or movable foil stabilizers has been tried but sufficient stabilization has not yet been obtained. In particular, it has been impossible to control the pitching oscillation. As long as the vessel has self-stabilizing ability, the vessel is inevitably subjected to large heeling forces and heel recovery forces which oscillate the vessel.

It has been considered to use a submarine as a merchant cargo vessel. A submarine does not oscillate and has a high propulsion efficiency at high speed, but it has a risk of safety in the deep sea water and needs a lot of ballast to sink in water when it carries cargoes lighter than water. Further, the cargo space is limited under water and thus it is extremely not uncommon as a merchant vessel.

As one development of modern shipbuilding technology, hydrofoil vessels have appeared. .Since these vessels have no self-stabilizing ability in a state of cruising, no oscillation takes place when a vessel is subjected to waves, but it cannot be a large vessel because the area of the foil is limited to support the vessel weight. Recent air cushion vehicles called ACV including hover craft and surface effect ships have a high propulsion efficiency such as to achieve a high speed of almost 100 Knots. The ACV, however, has a weak point in maneuverability and thus it is not suitable for navigation in waves as a merchant vessel.

Catamaran type vessels have been considered. Originally, the twin hull vessel was just a combination of two conventional displacement mono-hull type vessels. In order to improve the propulsion efficiency, the vessel movability and carriability of cargo, a vessel called SWATH which means Small Waterplane Area Twin Hulls is becoming popular.

SWATH consists of two lower hulls under water, an upper hull above water and struts connecting these. SWATH navigates in a semisubmerged state and this vessel receives the buoyancy force derived from the displacement of the submerged hulls. Thus the scale up to a large vessel can be easily done and the cargo can be carried on the upper hull without limitation. However, as long as self-stabilizing ability is needed for the SWATH, SWATH cannot avoid oscillation. And also it causes big trouble that SWATH has the submerged hulls in the shallow draft state.

An Extended Performance Hydrofoil vessel called EPH which navigates in a semisubmerged state has also been considered. EPH is equipped with mono buoyancy tank and hydrofoils. EPH has no self-stabilizing ability in a state of cruising, and therefore EPH is an oscillationless vessel. But it causes big trouble that EPH has a submerged hull in the shallow draft state.

The submerged hull generates large wave exciting forces at hull shape changes during navigation in the shallow draft state. The vertical component of the wave exciting force is the wave heaving force. The wave heaving force is a source of oscillation of the vessel. End structures including struts at the fore and aft of the vessel form hull shape changes parts and can be a source of wave heaving force which may cause the oscillation of the vessel particularly in the longitudinal direction. Further a high-power propelling means of the multi-axial type concentrated at the aft part forms a hull shape change and can be a source of a large wave heaving force causing a longitudinal oscillation of the vessel.

The foregoing is the background of the pursuit of the oscillationless ocean going vessel of the type according to this invention.

SUMMARY OF THE INVENTION

The object of this invention is to solve the problems concerning the motions of a vessel navigating at high speed for a long time on the sea surface with waves, the problems being that a vessel must have self-stabilizing ability with sufficient reserve buoyancy against heeling of the vessel to be safe in oscillation, but as long as the vessel has self-stabilizing ability, it cannot avoid oscillation, and that when a vessel with self-stabilizing ability is navigating at high speed on the sea surface with waves, it is subjected to large acceleration motions. When an acceleration motion of more than ($\frac{1}{2}$)G occurs in a vessel, damage occurs in the hull and machinery, and moreover the human body cannot endure the motion for a long time. This is the contradiction between the stability and oscillation of a vessel.

The vessel according to this invention is an oscillationless semisubmerged high-speed vessel in which a mono-lower hull or twin-lower hulls submerged below the water surface and an upper hull above the water in the navigation state are connected by way of struts.

This vessel does not oscillate when it is navigating in waves, firstly because the vessel has a very small water plane area and thus a very small reserve buoyancy, whereby it does not have a self-stabilizing ability against heeling of the vessel. In other words, the vessel is not subjected to pitching and rolling moment in waves. For this reason it does not oscillate in waves. Secondly, because the strut structures connecting the lower hull and the upper hull and bulged structures containing propelling means are disposed concentratedly at the midship parts of lower hulls to minimize the longitudinal oscillation of the vessel and thus the wave heaving forces generated at fore and aft parts of the lower hulls are composed so as not to be large sources of longitudinal oscillation. Thirdly, because the vessel has steering devices which are disposed at the fore part of the lower hulls and respond rapidly to prevent the vessel from transverse oscillation, the vessel can have characteristics to cancel the transverse oscillation at an initial stage of heeling and to return the vessel to the original position.

The history of development of a vessel for a leading role in marine transportation can be said in a word to be "pursuit of speed and scale". Shipbuilding technology to increase the speed has developed a slender displacement monohull type vessel like a warship, and recently produced a hydrofoil vessel and an air cushion vehicle like hover craft and surface effect ship called SES. From the view point of propulsion efficiency at high speed of the vessel, the semisubmerged type vessel of this invention cannot beat the slender monohull type vessel, hydrofoil type vessel and air cushion type vessel. However, the slender displacement monohull type vessel has a weak point in oscillation motion due to its sufficient self-stabilizing ability. This is not a vessel which can navigate at high speed for a long time on the surface of the ocean with waves. The hydrofoil type vessel has sufficient oscillationless maneuverability on a wave surface, but it is lacking in pursuitability of scale, namely it cannot be a big vessel. Further, the air cushion type vessel is a vessel floating above the water surface by means of air pressure and thus has a decisive weak point in the stability and the maneuverability on the wave surface.

No matter how high the propulsion efficiency of a high speed vessel may be, the vessel must be based on the principle that an oscillating vessel cannot be a high speed vessel going in waves for a long period of time.

The vessel including a mono-lower hull o twin-lower hulls of this invention solves the above mentioned problems and can be an epoch making vessel which plays an important role in marine transportation at high speed across the ocean.

The basic concept of this invention is that "an oscillationless semisubmerged high-speed vessel having struts connecting the lower hull and the upper hull must have no stabilizing ability longitudinally and transversely with only reserve buoyancy provided by the struts."

Also, the concept of this invention is that "strut structures connecting the lower hull and the upper hull and bulged structures containing propelling means are disposed at midship parts of the lower hulls to minimize longitudinal oscillations of the vessel."

Further, the concept of this invention is "to install steering devices at the fore part of the lower hull in order to the cancel transverse oscillating tendency at an initial stage."

The vessel with only high propulsion performance which is the most important subject for naval architectural technology from ancient times, however, cannot be a high speed ocean going merchant vessel if it has no oscillationless ability in the wave sea surface.

The vessel of this invention is an oscillationless ocean going high speed vessel.

The nature and utility of this invention will be more clearly apparent from the following detailed description with respect to preferred embodiments of this invention when read in conjunction with the accompanying drawings, briefly described below.

BRIEF DESCRIPTION OF THE DRAWINGS

FIGS. 10 and 11 are, respectively, a side view and a plan view of a vessel for explaining the concept of this invention in which a large wave heaving force generated at the midship part does not produce a moment which heels the vessel in the longitudinal direction even when separated high power propelling means are disposed at the midship part of the lower hull;

FIG. 12 is a view showing an example of wave heaving forces acting at various parts of the vessel in the state in which the vessel is cruising in the wave in FIG. 10;

FIGS. 13-1 through 13-5 are views showing various examples of struts composing the vessel to explain the concept of this invention in which a large wave heaving force generated on the strut disposed at a midship part of the lower hulls does not produce a moment which heels the vessel in the longitudinal direction;

DETAILED DESCRIPTION OF THE INVENTION

Figure 1:
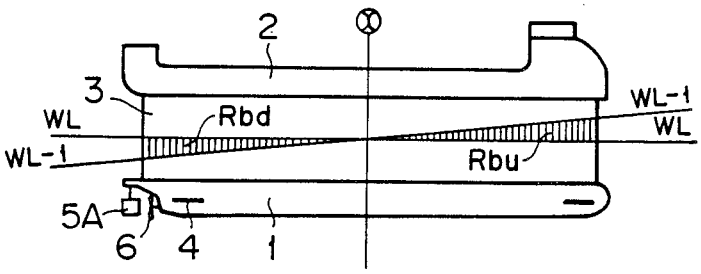
FIG. 1 is a side view showing the basic concept of an oscillationless semisubmerged high-speed vessel according to this invention.
Figure 2:
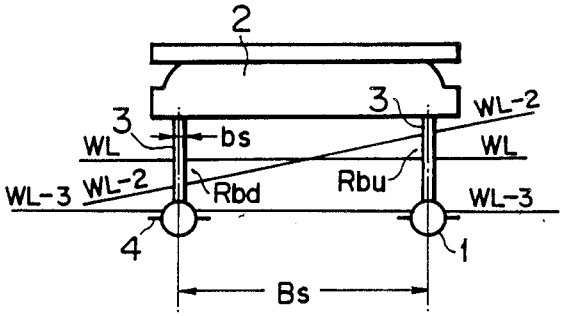
FIG. 2 is a rear view showing the basic concept of the vessel having twin-lower hulls of this invention.
Figure 3:
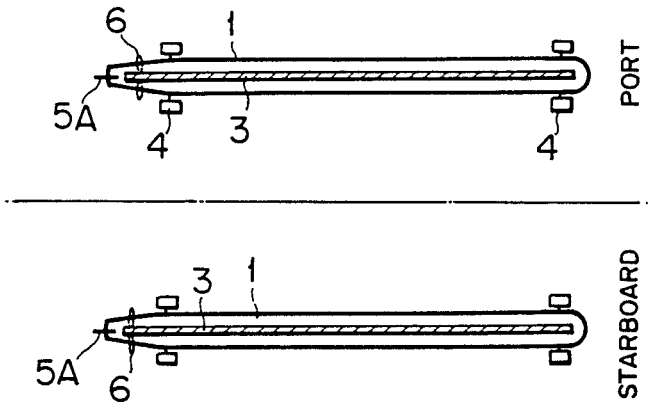
FIG. 3 is a sectional plan view of the vessel having twin-lower hulls of this invention.
Figure 4:
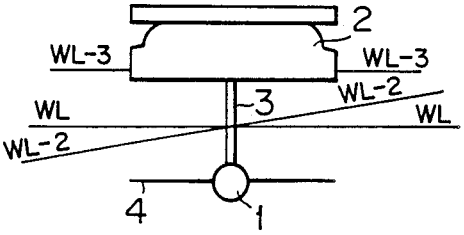
FIG. 4 is a rear view showing the basic concept of the vessel having mono-lower hull according to this invention.
Figure 5:
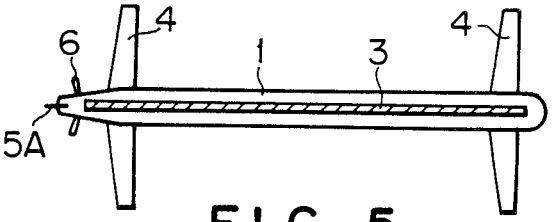
FIG. 5 is a sectional plan view of the vessel having a monolower hull of this invention.

FIG. 1 is a side view for explaining the basic concept concerning the stability due to reserve buoyancy of an oscillationless semisubmerged high-speed vessel including twin-lower hulls or a mono-lower hull of this invention. The vessel does not have a self-stabilizing ability against longitudinal and transverse heeling of the vessel with only reserve buoyancy kept by the struts. FIG. 2 is a rear view for explaining the basic concept concerning the stability due to reverse buoyancy of the vessel having twin lower hulls. FIG. 3 is a plan view of FIG. 2. FIG. 4 is a rear view for explaining the basic concept concerning the stability due to reserve buoyancy of the vessel having a mono-lower hull. FIG. 5 is a plan view of FIG. 4.

In FIG. 1, 1 designates a lower hull; 2, an upper hull; 3, a strut connecting the hulls 1 and 2; and 4, horizontal fins controlling longitudinal and transverse oscillations. 5A designates a rudder provided at the aft part of the lower hull 1 and 6 designates a propelling device. WL and WL-1 are water lines. Rbu is an upward reserve buoyancy and Rbd is a downward reserve buoyancy. FIG. 1 illustrates the basic concept concerning the longitudinal stability of the vessel of this invention. This figure shows that the vessel heels in the longitudinal direction and the water line changes from WL to WL-1 which exerts an upward buoyancy Rbu and a downward buoyancy Rbd on the strut 3. In the case where the water plane area of the strut is sufficiently large and the vessel holds a sufficient reserve buoyancy for self-stabilizing, the reserve buoyancies Rbu and Rbd will produce a righting moment for the vessel and thus the vessel will be self-stabilized.

On the other hand, if the water plane area of the strut 3 is small and the vessel does not have reserve buoyancy for its self-stabilizing, the vessel will not self-stabilize.

In FIG. 2, the breadth of the strut 3 is indicated by bs. Bs is the spacing of the two struts 3. FIG. 2 illustrates the basic concept concerning the transverse stability of the vessel, similar to that concerning the longitudinal stability shown in FIG. 1.

It is the basic concept of this invention that the oscillationless vessel must have no self-stabilizing ability against longitudinal and transverse heeling of the vessel.

In FIG. 4 is illustrated the basic concept concerning the transverse stability of the vessel similar to that shown in FIG. 2, but having a mono-lower hull.

In FIGS. 2 and 4, WL-3 is a water line on which the vessel is to be afloat when it is stopped or during low speed cruising.

Figure 6:
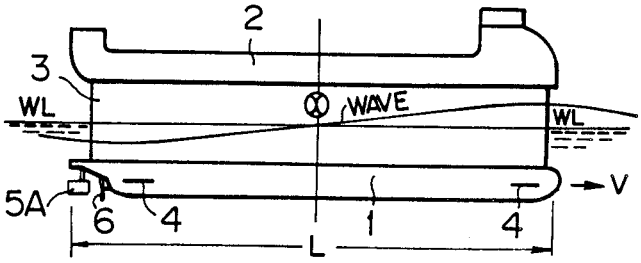
FIG. 6 is a side view for explaining the manner in which the vessel of this invention is subjected to wave heaving forces due to waves in its navigating state.
Figure 7:
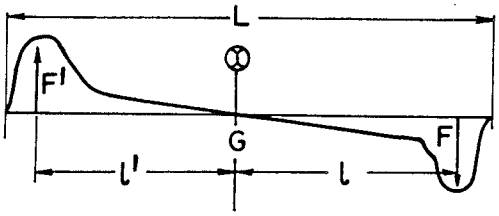
FIG. 7 is a view showing an example of wave heaving forces acting at various parts of the vessel in the state of the wave shown in FIG. 6.

In FIGS. 6 and 7 is explained the production of longitudinal oscillation due to the wave heaving force which is a vertical component of the wave exciting force. In FIG. 6, L is the length of the lower hull 1, V is the navigating speed and wave is shown to have a wave length of 2L.

The wave here is a wind wave generated on the natural sea surface due to external forces such as winds and it does not include ship wave generated by ship itself during navigation.

FIG. 6 shows in side view a vessel in a semisubmerged state with the water line WL, navigating at a speed V in the wave having a length 2L with the wave crest at the fore part and the wave bottom at the aft part of the vessel.

As shown in FIG. 7, resultant wave heaving forces F and F′ are generated at the fore and aft parts of each of the lower hulls 1, respectively, $\lambda$ and $\lambda'$ are the distance from the points of the forces F and F′ to the center of gravity G of the vessel, respectively.

FIG. 7 is a conceptual illustration of wave heaving forces generated on various parts of each lower hull 1 of the vessel in the state of wave in FIG. 6. A part of the lower hull 1 advancing under water generates wave exciting forces where the hull shape changes The greater the speed, the greater is the wave exciting force. The vertical component of this wave exciting force is a wave heaving force. In FIG. 7 is shown an example wherein the fore part of the lower hull advancing under water has an extraordinary hull shape change which can be a source of a large wave heaving force. Further, in FIG. 7 is shown that the force F is generated at the fore part of the lower hull in the wave crest and the force F′ is generated at the aft part of the lower hull in the wave bottom in the opposite direction to each other and that in relation to the distance $\lambda$ or $\lambda'$ from the center of gravity G, a large longitudinal oscillating moment is generated.

Figure 8:
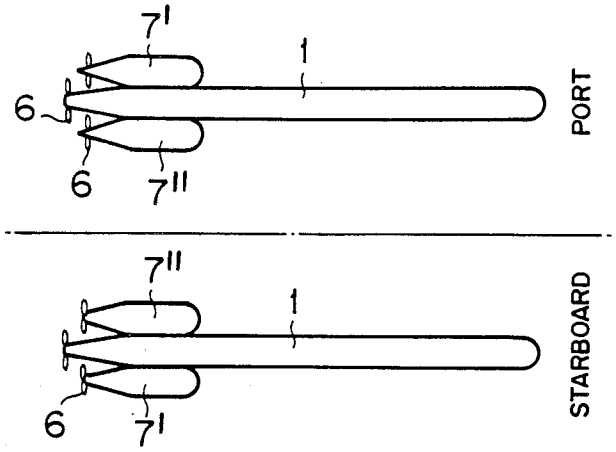
FIG. 8 is a plan view of a vessel equipped with separated high power propelling means disposed at the aft part of the lower hulls in a conventional manner.
Figure 9:
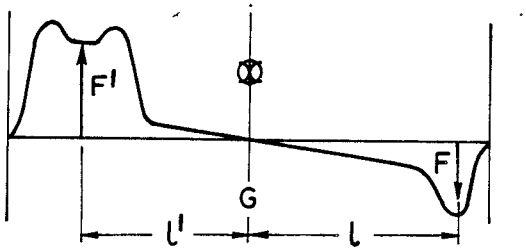
FIG. 9 is a view showing an example of wave heaving forces acting at various parts of the vessel in the state in which the conventional vessel equipped with separated high power propelling means disposed at the aft part of the lower hull and subjected to large wave heaving forces causing a moment which heels the vessel in the longitudinal direction during cruising in a wave as shown in FIG. 6.

FIGS. 8 to 12 show the concept of this invention based on bulged structures relating to the longitudinal oscillation of the vessel. The bulged structures 7′ and 7″ of FIG. 8 cause hull shape changes which generate large wave heaving forces as shown in FIG. 9. In the present invention, they are disposed in a midship part which occupies one-third of the length of each lower hull including the midship to minimize the longitudinal oscillation of the vessel due to changes of wave heaving forces generated at both fore and aft parts of the vessel. The bulged structures 7′ and 7″ are include the propelling devices 6. As shown, the bulged structures 7′ and 7″ are disposed on the outside and the inside of each of lower hulls 1, respectively.

As shown in FIG. 8, the port and starboard lower hulls 1 of the vessel have through type struts and high power propelling means 6 disposed on three axes at an aft part of each of the lower hulls. Among the three propelling means 6, two are installed in the two bulged structures 7′, 7″ disposed at the aft part of each lower hull 1.

FIG. 9 is a conceptual view showing how the wave heaving forces are generated at different parts of the lower hull of the vessel which is navigating at a speed V in a wave of the length 2L with the wave crest at the fore part and the wave bottom at the aft part of the vessel as shown in FIG. 6. In FIG. 9, the bulged structures disposed at the aft part of the lower hull travelling under water form hull shape changes which can be a big source of the wave heaving forces compared with the fore part of the lower hull. Thus the generated wave heaving force F' generates a large moment to oscillate the vessel in the longitudinal direction.

Figure 10:
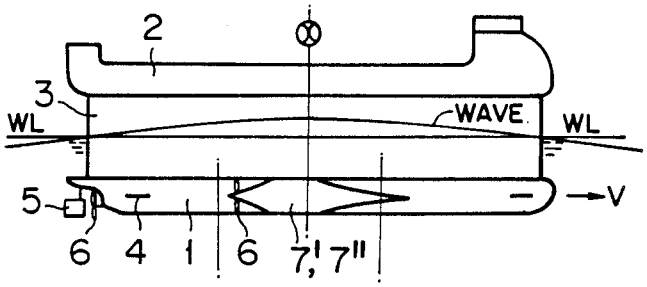

The vessel shown in FIG. 10 has through type struts 3 with high power propelling means 6 disposed on three separate axes in the lower hull 1. The two axes of propelling means pass through the two bulged structures 7' and 7" disposed on both the outside and inside of the lower hull at a midship part. The vessel is navigating at a speed V in a wave of the length 2L with the wave crest at the midship of the vessel.

FIG. 11 is a port side plan view of the vessel shown in FIG. 10. In FIG. 11, SC designates a hull shape change which generates a large wave heaving force. The bulged structures are disposed in a midship part which occupies one-third of the length of the lower hull including the midship.

FIG. 12 is a conceptual view showing an example of the wave heaving forces generated at different parts of the vessel shown in FIGS. 10 and 11. In FIG. 12, F" is a resultant wave heaving force at the midship part of the lower hull. The bulged structures 7' and 7" disposed at a midship part of the lower hull travelling under water function as big sources of the wave heaving forces. Although the force F" is large, the distance λ" from the center of gravity G of the vessel to the point where the force F" is exerted is small, and thus the generated resultant force F" does not generate a large moment to oscillate the vessel in the longitudinal direction FIGS. 13-1 through 13-5 show the concept of this invention concerning the strut structure as related to the longitudinal oscillation of the vessel. In the vessel shown in these figures, the hull shape changes due to the strut structure which generate a large wave heaving force are disposed in a midship part which occupies one-third of the length of the lower hull including the midship to minimize the longitudinal oscillation of the vessel due to the changes of wave heaving forces generated at both fore and aft parts of the vessel. The hull parts producing such changes are either a whole strut or partial struts maintaining a sufficient strength for connection of the lower hull and the upper hull. FIG. 13-1 shows a through strut extending over the entire length of the lower hull, and FIG. 13-2 shows separate struts disposed separately along the lower hull. 3', 3" and 3"' designate separate struts at a fore, a midship and an aft part of a lower hull, respectively. FIG. 13-3 through 13-5 show structures 3-M of a midships strut having a sufficient strength for connection of the lower hull and the upper hull. 3-M in FIG. 13-3 shows the midship strut only. The structure of 3-M in FIG. 13-4 further includes the through strut 3. The structure of 3-M in FIG. 13-5 further includes separate struts 3', 3" and 3"'. Thus the concept of this invention concerning the strut structure, which is to minimize longitudinal oscillations of the vessel due to the changes of wave heaving forces generated at both fore and aft parts of the vessel, is embodied by the strut structure 3-M disposed in a midship part of the lower hulls in FIGS. 13-3 through 13-5.

FIG. 12 shows wave heaving forces caused by the structures 3-M. In FIG. 12, the structure 3-M disposed in the midship part of the lower hull can function as a big source of the wave heaving force and generates a resultant wave heaving force F" in the midship part. Although the force F" is large, the distance λ" from the center of gravity G of the vessel to the point of the force F" is small, so that it does not generate a large oscillating moment to pitch the vessel in the longitudinal direction.

Figure 14:
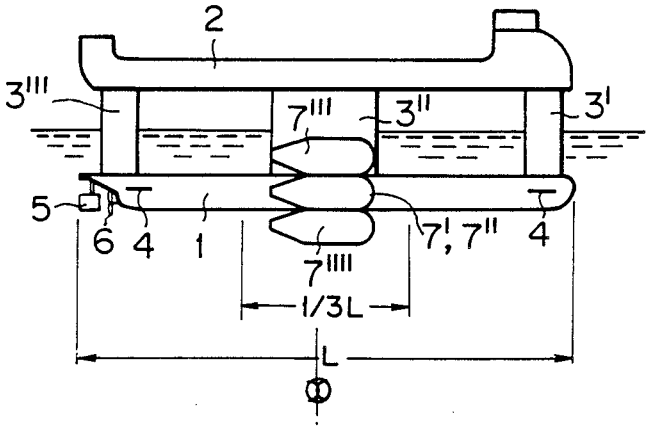
FIGS. 14 and 15 are, respectively, a side view and a rear view of the vessel of this invention for explaining the arrangement of the bulged structures in which the separated high power propelling means are contained and which is disposed at a midship part of the lower hulls to minimize longitudinal oscillations of the vessel due to wave heaving forces.
Figure 15:
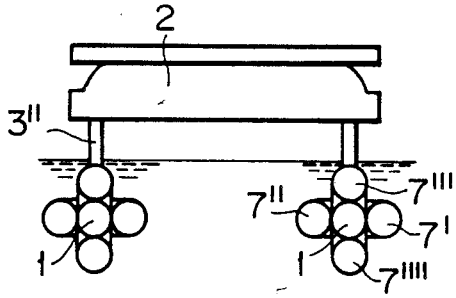

FIGS. 14 and 15 show a possible disposition of the bulged structure having propelling means arranged on separate axes at a midship part of the vessel having twin-lower hulls.

In FIG. 14, a side view, and FIG. 15, a rear view, 7' and 7" indicate bulged structures disposed at the outside and the inside of a midship part of the lower hull, and 7"' and 7"" indicate bulged structures at the top and the bottom of the midship part of the lower hull, respectively. The disposition of the bulged structures is not limited to that shown in FIGS. 14 and 15 but a diagonal arrangement of the structures is also possible. Further, the disposition of some selected bulged structures from among the four above the lower hull is possible. Furthermore, the same disposition of the bulged structures can be applied to a vessel having a mono-lower hull.

Figure 16:
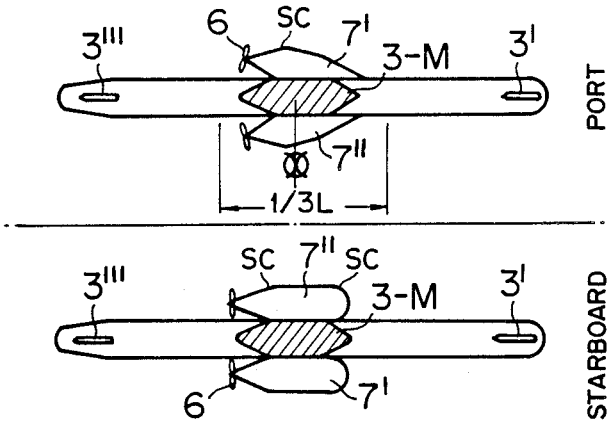
FIGS. 16 and 17 are, respectively, a plan view, partly in section, and a rear view, partly in horizontal section, showing a disposition of the bulged structures selected from the disposition shown in FIGS. 14 and 15.
Figure 17:
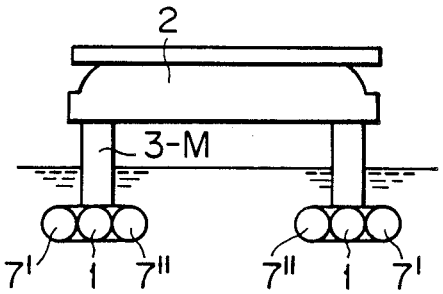

FIGS. 16 and 17 are, respectively, a plan view and a rear view showing a disposition of two bulged structures 7' and 7" at the outside and the inside of a midship part of the lower hull of the vessel having twinlower hulls where different types of propelling means are installed on the port side and the starboard side. A midship strut 3-M provides a sufficient strength for connection of the lower hull 1 and the upper hull 2.

Figure 18:
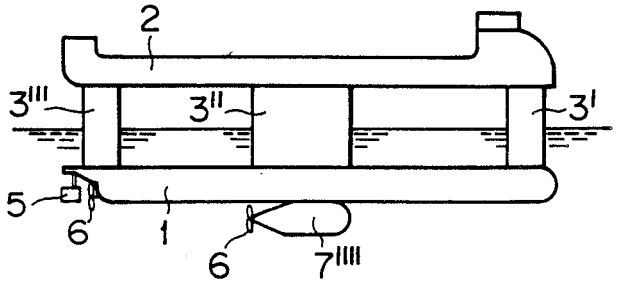
FIGS. 18, 19, 20, 21 and 22 are, respectively, a side view, a rear view, a plan view partly in section, a side view and a plan view partly in section, showing a disposition of the bulged structures selected from the disposition shown in FIGS. 14 and 15.
Figure 19:
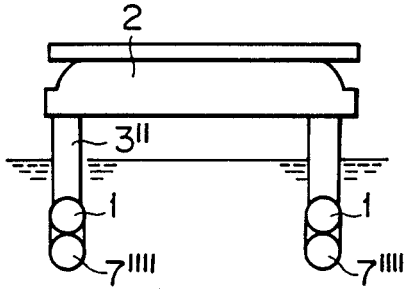

FIGS. 18 and 19 show a side view and a rear view of a vessel having a bulged structure 7"" disposed at the bottom of the lower hull of the vessel having twin-lower hulls.

Figure 20:
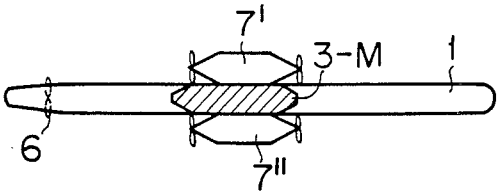

FIG. 20 shows a manner of providing of the propelling means different from the manner shown in the other figures.

Figure 21:
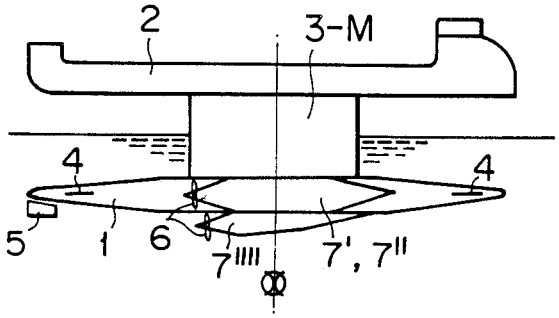
Figure 22:
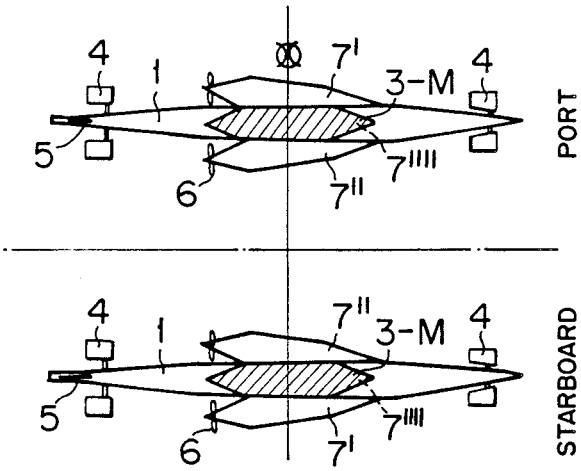

FIGS. 21 and 22 are a side view and a plan view of a vessel having twin-lower hulls according to an extreme embodiment of this invention incorporates the basic concept about the stability due to the reserve buoyancy described in connection with FIG. 1, incorporates the concept of the strut structure for the longitudinal oscillation described in in connection with FIG. 13 and incorporating the concept of disposition of the bulged structure to minimize the longitudinal oscillation described in connection with FIG. 8 through FIG. 12.

In these figures, 3-M constitutes a whole structure strut and 7', 7" and 7"' are bulged structures disposed at both sides and the bottom of the lower hull 1. The vessel shown in FIGS. 21 and 22 embodies the above concepts but abolishes the propelling means at the aft parts of the lower hulls and has the fore and aft parts of the lower hulls formed without the hull shape changes to avoid the generation of the large wave heaving forces at the fore and the aft parts of the vessel. Therefore, the longitudinal oscillating moment of the vessel can be limited to a minimum and the- vessel can be controlled to have an even draft longitudinally by the horizontal fins 4.

FIGS. 23 through 29 illustrate the concept of steering devices for controlling the transverse oscillation of the vessel. The rudders are disposed at at least the fore part of each lower hull. In these figures, 5F and 5A indicate rudders installed at a fore part and an aft part of each lower hull of the vessel, respectively, $R_R$ and $R_L$ are reSultant rudder face pressures in the right direction and in the left direction, respectively, G designates the center of gravity of the vessel; B, the center of buoyancy; and $M_R$ and $M_L$, moments to make the vessel oscillate to the right and to the left, respectively.

Figure 23:
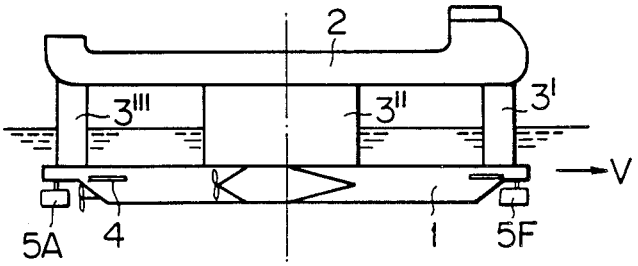
FIGS. 23, 24 and 25 are, respectively, a side view, a plan view and a rear view of a vessel having twin-lower hulls, for explaining the concept of this invention concerning a rudder which is disposed at the fore part of the lower hull under water to cancel the transverse oscillation of the vessel.
Figure 24:
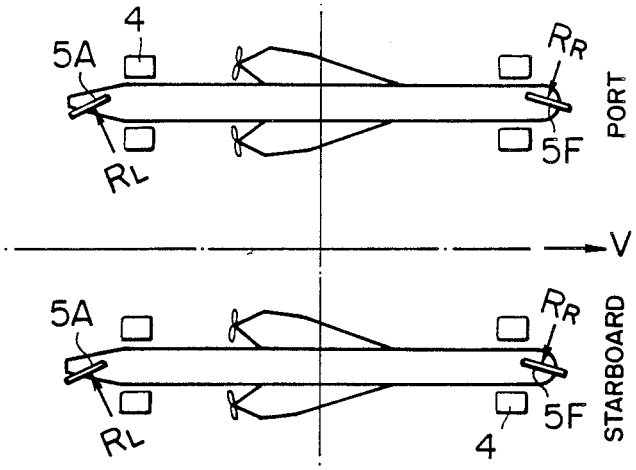

FIGS. 23 and 24 are a side view and a plan view of the vessel having twin-lower hulls in accordance with the concept of this invention. The vessel is equipped with rudders 5F at a fore part of the lower hulls, and navigates at a speed V. In FIG. 24, the rudders 5F and 5A are are controlled to make the vessel turn to the right. The fore rudder 5F is subjected to the rudder face pressure $R_R$ in the right direction and the aft rudder 5A is subjected to the rudder face pressure $R_L$ in the left direCtion.

A twin-lower hull type vessel without self-stabilizing ability has a tendency to heel more when it starts to heel. The concept of this invention is to install the rudders at the fore part of each lower hull to cancel the transverse heeling of the vessel in an initial stage of turning action.

Figure 25:
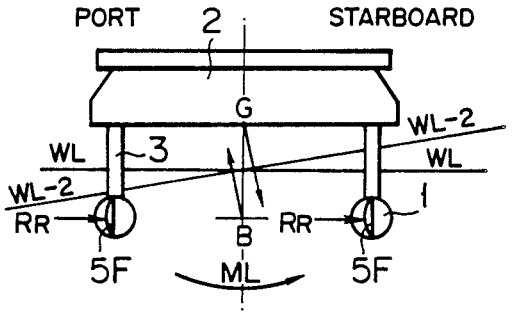
Figure 26:
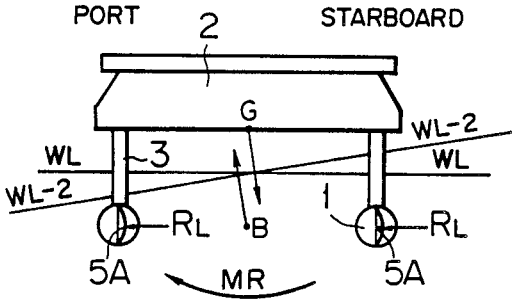
FIG. 26 is a rear view of a vessel having twin-lower hulls, for explaining the transverse heeling action of the conventional rudder which is disposed at the aft part of the vessel.

FIGS. 25 and 26 are rear views illustrating the above stated tendency and the concept. In FIG. 25, when the vessel heels to the right and water line changes from WL to WL-2, the shifting occurs in the center of gravity G and the center of buoyancy B and the vessel tends to heel more to the right. In order to cancel the heeling, one may shift the vessel itself by turning the rudder by an amount of shifting of the center of gravity. This is the principle of stability due to "center of gravity shifting" similar to the riding stability on a bicycle.

FIG. 25 shows the principle to make a heeled vessel return to an upright position in an initial stage of heeling; when the fore rudder 5F is turned to the right, the rudder face pressure $R_R$ acts in the right direction and a moment $M_L$ which makes the vessel heel to the left is generated before the shifting of the center of gravity due to the centrifugal force of the turning vessel.

FIG. 26 shows a principle in which when the aft rudder 5A is turned to the right to shift the center of gravity of the vessel against the heeling of the vessel to the right, the rudder face pressure $R_L$ acts in the left direction on the rudder face, the moment $M_R$ to heel the vessel to the right -is generated and the vessel heels more in the same direction.

Figure 27:
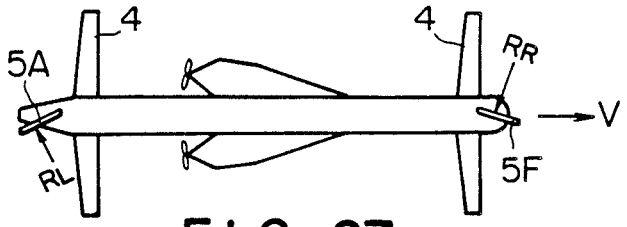
FIGS. 27 and 28 are, respectively, a plan view and a rear view of a vessel having a mono-lower hull, for explaining the concept of this invention concerning a rudder which is disposed at the fore part of the lower hull to cancel the transverse heeling of the vessel.
Figure 28:
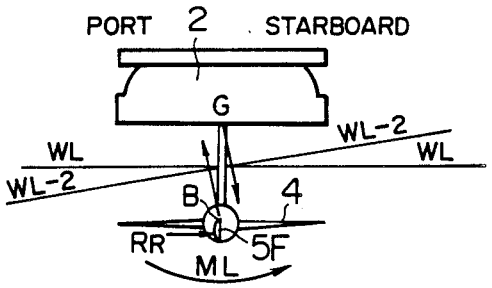
Figure 29:
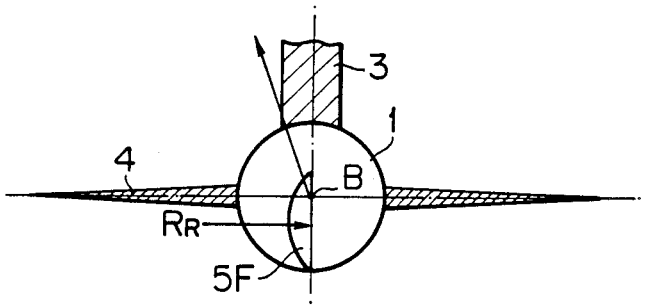
FIG. 29 is a view, on an enlarged scale, showing a part of FIG. 28.

FIGS. 27 and 28 are a plan view and a rear view showing a mechanism and a concept of the fore rudder of the vessel having mono-lower hull.

In FIG. 27, the rudders 5F and 5A are being turned to the right. The fore rudder 5F is subjected to $R_R$ in the right direction.

The control method is applicable to turn the fore rudder to the right and the aft rudder to the left, to obtain a righting moment $M_L$, respectively, at an initial stage when the vessel heels to the right.

In FIG. 28, when the fore rudder 5F is turned to the right, a moment $M_L$ which makes the vessel heel to the left iS generated and a heeled mono-hull type vessel returns to an upright position against the increasing heeling tendency to the right in a manner similar to the twin-lower hull type vessel shown in FIG. 25. The rudders shown in FIGS. 23 through 28 may be replaced by side thrusters.

FIGS. 1 through 28 concern a vessel having twin-lower hulls or a mono-lower hull. However, the principle of this invention may be applied to vessels having more than two lower hulls.

The semisubmerged vessels according to the concepts of this invention shown in FIGS. 1 through 28 can be oscillationless high speed vessels which can navigate at high speed for a long time without causing such large accelerative oscillation due to waves as will cause damage to the vessel and the human bodies, because of extremely small longitudinal oscillating forces which are controlled by the horizontal fins installed on each lower hull and cancelling the transverse oscillation in an initial stage by the use of the rudders which can be installed not only at a fore part of each lower hull but also at fore parts of the vessel under water except the lower hulls.

What is claimed is:

1. An oscillationless semisubmerged high speed vessel, comprising:

at least one lower hull for being submerged below a water surface in the cruising state of the vessel, said lower hull having horizontal fins provided at least at the fore and aft parts thereof for controlling longitudinal and transverse oscillations of the vessel, steering means, water ballast tank means for adjusting the depth to which the vessel will sink into the water, and propelling means;

strut means fixed to said lower hull and extending upward therefrom past the position of the water surface on said strut means and having a sufficiently small water plane area and therefore a small reserve buoyancy such that the vessel does not have a self-stabilizing ability both longitudinally or transversely thereof;

an upper hull fixedly supported on the upper end of said strut means; and said strut means having at least a midship strut having sufficient for connection of said lower hull and said upper hull and having parts at which the shape changes and which generate large wave heaving forces, said strut means being positioned at a midship part of said hulls which extends one third of the length of said lower hull, whereby longitudinal oscillations of the vessel due to changes of the wave heaving forces which are vertical components of wave exciting forces generated at the fore and aft parts of said vessel are minimized.

2. A vessel as claimed in claim 1 in which said strut means further comprise fore and aft struts between said lower hull and said upper hull, said fore and aft struts having a profile which generates only small wave heaving forces.

3. A vessel as claimed in claim 1 in which said strut means further comprises struts connected to the fore and aft ends of said midship strut and having a profile which generates only small wave heaving forces.

4. An oscillationless semisubmerged high speed vessel, comprising:

at least one lower hull for being submerged below a water surface in the cruising state of the vessel, said lower hull having horizontal fins provided at least at the fore and aft parts thereof for controlling longitudinal and transverse oscillations of the vessel, steering means, and water ballast tank means for adjusting the depth to which the vessel will sink into the water;

strut means fixed to said lower hull and extending upward therefrom past the position of the water surface on said strut means and having a sufficiently small water plane area and therefore a small reserve buoyancy such that the vessel does not have a self-stabilizing ability both longitudinally or transversely thereof;

an upper hull fixedly supported on the upper end of said strut means; and underwater bulged structures containing propelling means and having parts at which the shape changes and which generate large wave heaving forces, said bulged structures being mounted on said lower hull at a midship part of said hulls which extends one third of the length of said lower hull, whereby longitudinal oscillations of the vessel due to changes of the wave heaving forces which are vertical components of wave exciting forces generated at the fore and aft parts of said vessel are minimized.

5. An oscillationless semisubmerged high speed vessel, comprising:

at least one lower hull for being submerged below a water surface in the cruising state of the vessel, said lower hull having horizontal fins provided at least at the fore and aft parts thereof for controlling longitudinal and transverse oscillations of the vessel, steering means, water ballast tank means for adjusting the depth to which the vessel will sink into the water, and propelling means;

strut means fixed to said lower hull and extending upward therefrom past the position of the water surface on said strut means and having a sufficiently small water plane area and therefore a small reserve buoyancy such that the vessel does not have a self-stabilizing ability both longitudinally or transversely thereof;

an upper hull fixedly supported on the upper end of said strut means; and said steering means including at least one rudder means disposed at a fore part of said lower hull.

6. An oscillationless semisubmerged high speed vessel, comprising:

at least one lower hull for being submerged below a water surface in the cruising state of the vessel, said lower hull having horizontal fins provided at least at the fore and aft parts thereof for controlling longitudinal and transverse oscillations of the vessel, steering means, water ballast tank means for adjusting the depth to which the vessel will sink into the water, and propelling means;

strut means fixed to said lower hull and extending upward therefrom past the position of the water surface on said strut means and having a sufficiently small water plane area and therefore a small reserve buoyancy such that the vessel does not have a self-stabilizing ability both longitudinally or transversely thereof;

an upper hull fixedly supported on the upper end of said strut means; and said steering means including at least one rudder means disposed at a fore part of a part of said vessel other than said lower hull.

* * * * *

UNITED STATES PATENT AND TRADEMARK OFFICE

CERTIFICATE OF CORRECTION

PATENT NO. : 4,986,204

DATED : January 22, 1991

INVENTOR(S) : Toshio YOSHIDA et al:

It is certified that error appears in the above-identified patent and that said Letters Patent is hereby corrected as shown below:

Column 6, lines 24 and 42, for "λ" and "λ'", read --ℓ-- and --ℓ'--;

Column 7, line 31 and column 8, line 3, for "λ''", read --ℓ''--;

Column 10, line 33, after "sufficient" read --strength--.

Signed and Sealed this

Twenty-first Day of July, 1992

*Attest:*

DOUGLAS B. COMER

*Attesting Officer*

*Acting Commissioner of Patents and Trademarks*